US005720785A

United States Patent [19]

Baker

[11] Patent Number: 5,720,785

[45] Date of Patent: Feb. 24, 1998

[54] METHOD OF REDUCING HYDROGEN CYANIDE AND AMMONIA IN SYNTHESIS GAS

[75] Inventor: Daniel Clark Baker, Houston, Tex.

[73] Assignee: Shell Oil Company, Houston, Tex.

[21] Appl. No.: 630,953

[22] Filed: Apr. 5, 1996

Related U.S. Application Data

[63] Continuation-in-part of Ser. No. 275,192, Jul. 13, 1994, abandoned, which is a continuation-in-part of Ser. No. 56,212, Apr. 30, 1993, abandoned, and Ser. No. 56,233, Apr. 30, 1993, abandoned.

[51] Int. Cl.[6] ..... C10J 3/06

[52] U.S. Cl. ..... 48/210; 423/236; 48/197 R

[58] Field of Search ..... 48/197 R, 200–202, 48/206, 210, 197 FM; 423/236

[56] References Cited

U.S. PATENT DOCUMENTS

| | | | |
|---|---|---|---|
| 2,516,141 | 7/1950 | Newman et al. | 48/203 |
| 2,644,745 | 7/1953 | Hemminger | 48/203 |
| 2,691,573 | 10/1954 | Mayland | 48/210 |
| 2,716,598 | 8/1955 | Moses | 48/206 |
| 2,794,725 | 6/1957 | Scharmann | 48/206 |
| 2,931,715 | 4/1960 | Du Bois Eastman | 48/63 |
| 2,962,367 | 11/1960 | Luerssn | 48/206 |
| 2,971,830 | 2/1961 | Toshio Kawai et al. | 48/206 |
| 3,773,912 | 11/1973 | Spangler | 423/574 |
| 3,985,519 | 10/1976 | Kalina et al. | 48/202 |
| 4,032,618 | 6/1977 | Matthews | 423/351 |
| 4,189,307 | 2/1980 | Marion | 48/197 |
| 4,201,751 | 5/1980 | Holter et al. | 423/210 |
| 4,233,275 | 11/1980 | Kimura et al. | 423/230 |
| 4,424,065 | 1/1984 | Langhoff et al. | 48/197 |
| 4,437,417 | 3/1984 | Roberts | 110/346 |
| 4,508,542 | 4/1985 | Langhoff et al. | 48/77 |
| 4,511,371 | 4/1985 | Blaskowski | 48/197 R |
| 4,598,652 | 7/1986 | Hepworth | 110/345 |
| 4,624,837 | 11/1986 | Baker | 423/215.5 |
| 4,666,462 | 5/1987 | Martin | 48/197 R |
| 4,668,428 | 5/1987 | Najjar | 252/373 |
| 4,668,429 | 5/1987 | Najjar | 252/373 |
| 4,671,804 | 6/1987 | Najjar | 48/197 R |
| 4,692,172 | 9/1987 | Stellaccio et al. | 48/197 R |
| 4,693,873 | 9/1987 | Baker | 423/215.5 |
| 4,704,137 | 11/1987 | Richter | 48/197 |
| 4,778,485 | 10/1988 | Suggitt et al. | 48/197 R |
| 4,803,061 | 2/1989 | Najjara et al. | 423/415 A |
| 4,808,386 | 2/1989 | Najjar et al. | 423/226 |
| 4,826,627 | 5/1989 | Najjar | 252/373 |
| 4,828,806 | 5/1989 | Flockenhaus et al. | 423/213.5 |
| 4,838,898 | 6/1989 | Mifflin et al. | 48/210 |
| 4,851,151 | 7/1989 | Najjar et al. | 252/373 |
| 4,851,152 | 7/1989 | Najjar | 252/373 |
| 4,861,346 | 8/1989 | Najjar et al. | 44/1 |
| 4,876,031 | 10/1989 | Najjar et al. | 252/373 |
| 4,909,958 | 3/1990 | Najjar | 252/373 |
| 4,950,308 | 8/1990 | Lang et al. | 48/62 R |
| 4,952,380 | 8/1990 | Najjar et al. | 423/210 |
| 4,969,931 | 11/1990 | Wu et al. | 48/197 R |
| 4,979,964 | 12/1990 | Sternling | 48/62 R |
| 5,112,586 | 5/1992 | Baker | 423/220 |
| 5,213,587 | 5/1993 | Ekstrom et al. | 48/197 R |
| 5,403,366 | 4/1995 | Leininger et al. | 48/197 R |

FOREIGN PATENT DOCUMENTS

| | | |
|---|---|---|
| 2928-222 | 1/1981 | Germany . |
| 5 6010-337 | 2/1981 | Japan . |
| 6 1274-729-A | 4/1986 | Japan . |
| 61-268792 | 11/1986 | Japan . |

OTHER PUBLICATIONS

Mori, Asami, and Ohtuska, "Role of Iorn Catalyst in Fate of Fuel Nitrogen during Coal Pyrolysis", *Energy & Fuels*, 1996, 10, 1022–1027.

Hayashi et al, "Role of Iron Catalyst Impregnated by Solvent Swelling Method in Pyrolytic Removal of Coal Nitrogen," *Energy & Fuels*, vol. 9, pp. 1028–1034.

*Primary Examiner*—Thomas G. Wyse

*Attorney, Agent, or Firm*—Beverlee G. Steinberg

[57] ABSTRACT

The invention is a method for reducing the hydrogen cyanide and ammonia content of a synthesis gas stream exiting a gasifier including mixing an iron-containing compound with a nitrogen-containing coal feed; gasifying the coal feed in the resulting mixture in an entrained flow gasifier have opposed burners under gasifying conditions thereby producing a gas comprising hydrogen and carbon monoxide; and recovering the gas stream having substantially reduced amounts of hydrogen cyanide.

19 Claims, No Drawings

METHOD OF REDUCING HYDROGEN CYANIDE AND AMMONIA IN SYNTHESIS GAS

This application is a continuation-in-part (CIP) of application Ser. No. 08/275,192, filed Jul. 13, 1994, now abandoned, which was a CIP of application Ser. Nos. 08/056,212 and 08/056,233, both filed Apr. 30, 1993, now abandoned.

FIELD OF THE INVENTION

The invention relates to a method for reducing the hydrogen cyanide (HCN) and/or ammonia ($NH_3$) content of a synthesis gas.

BACKGROUND OF THE INVENTION

The combustion of a carbonaceous material, such as a solid carbonaceous fuel, by reaction with a source of gaseous oxygen (usually in the form of air or oxygen containing carbon dioxide with little or no carbon monoxide) is well known. Different goals may be met by varying the amount of oxygen which is added which is added. The oxygen may be added in an amount equal to or greater than that required for complete combustion, thus ensuring complete combustion of the carbonaceous feed. Alternatively, a limited quantity of oxygen may be used, resulting in gasification or partial oxidation of solid carbonaceous materials to produce primarily carbon monoxide and hydrogen.

Problems encountered during the gasification process vary depending upon the type of feeds used. With liquid hydrocarbon and petroleum coke feeds, there is insufficient ash content in the feed to create a slag having an adequate viscosity to flow. The slag is formed from the incombustible mineral content of the feed and forms an undesirable layer on the internal walls of the gasifier. Nickel and vanadium content is also higher in liquid hydrocarbon and petroleum coke feeds. Optimum slag viscosity is necessary to adsorb and remove nickel and vanadium metals, thus reducing their presence in the synthesis gas and the reactor. It is taught in U.S. Pat. No. 4,668,428 that adding iron additives to liquid hydrocarbon and petroleum coke feeds before combustion can be beneficial in reducing the viscosity of the slag. This results in the slag washing the vanadium and nickel out of the gasifier.

Coal feeds typically contain from 10–20 percent by weight ash while heavy liquid hydrocarbons and petroleum coke only have from one-half to 5 percent by weight ash. Thus, combusted coal feed forms slag with fairly low viscosity and slag is no longer a problem. Coal feeds, however, present different problems. Coal typically contains nitrogen, commonly called "coal nitrogen," which can react to form undesirable products. Upon gasification of the coal, the nitrogen forms hydrogen cyanide and/or ammonia in the synthesis gas mixture. These compounds cause severe corrosion in the upper walls of the gasifier and the downstream processing equipment.

Hydrogen cyanide and ammonia also pose environmental and safety hazards if emitted into the atmosphere. In the past, the bulk of the HCN was removed by raising the temperature of the gasifier; however, temperature elevation has its limitations and it has not been possible to remove residual amounts which are becoming an environmental concern. By example, the problem caused by HCN in coal gasification is similar to the $NO_x$ problem seen in combustion. Although the majority of the HCN can be eliminated, there is a finite residual amount which becomes very difficult to get rid of. A method which can eliminate most of the residual HCN in a gasses stream would be highly desirable.

Coal gasification feedstock may also form hydrogen sulfide ($H_2S$) when combusted. U.S. Pat. No. 4,808,386 teaches removal of sulfur from synthesis gas by addition of supplemental iron compounds to the gasifier. However, the relatively low temperatures of the gasifier disclosed in the '386 patent are not suitable for removing HCN and/or ammonia. The iron compound used in the '386 patent is consumed by reaction with the sulfur in the coal to form iron sulfides. Once converted to a sulfide, the iron is no longer available for further reaction. This leads to relatively high costs for supplying fresh iron compound to the process. Further, the water added to the system in the '386 patent causes HCN present to convert to ammonia.

It would be advantageous to have a practical and efficient method of reducing the hydrogen cyanide and ammonia present in a synthesis gas product.

SUMMARY OF THE INVENTION

The invention provides a method for reducing the hydrogen cyanide and ammonia present in a synthesis gas stream exiting a gasifier. An iron-containing compound is admixed with a nitrogen containing dry coal feed. The coal feed in the resulting mixture is then gasified in an entrained flow gasifier under gasifying conditions wherein the gasifier includes opposed burners which produce a flame zone having a temperature greater than about 1650° C., thereby producing a gas comprising hydrogen and carbon monoxide with reduced amounts of hydrogen cyanide and/or ammonia. The gas stream with reduced hydrogen cyanide and ammonia present is then recovered.

DETAILED DESCRIPTION OF THE EMBODIMENTS

A. Feeds, Iron-Containing Compounds, and Mixtures Thereof

Several types of coals are suitable for feed sources. These include bituminous coal, anthracite coal, and lignite. The coal feed is preferably dry; i.e., it is preferred that there is an insignificant amount of water present other than that naturally occurring in the coal.

The terms "iron compounds" and "iron-containing compounds" as used herein include elemental iron, iron alloys and iron oxides, such as ferric oxide and ferrous oxide. The iron-containing compounds contain free iron. "Free iron" as used herein means iron which is available for interacting, either as a reactant or a catalyst, with other elements. In particular, free iron as used herein is not in the form of metal sulfides or metal cyanides. Iron alloys are available, for example, from machine shop waste. Ferric oxide is preferred for its economy and availability. Iron-rich fluxing material may also be used. A particularly preferred source of iron compound is recycled flyash and recycled slag fines, which become iron-rich as they carry iron out of the flame zone and gasifier. The iron compounds are optionally used individually or in combination. An iron-containing compound of at least 35 percent by weight iron, preferably at least 50 percent by weight iron, is mixed with a nitrogen containing coal feed to provide an overall feed mixture which is not more than about 10 percent by weight iron based on the weight of the coal feed. The preferred iron compound is selected from the group consisting of recycled iron-rich flyash, recycled iron-rich slag fines, and mixtures thereof.

The coal feed and the iron compound are mixed either in the gasifier before combustion, or upstream of the gasifier. A particularly efficient method of mixing is to pulverize the feed and the iron compound together in the pulverizer. The coal feed and/or the iron compound are fed to the gasifier either dry or in a water slurry. If the iron compound is not mixed with the feed prior to introducing the feed into the gasifier, then the iron compound is mixed with the feed after the pulverizing stage or is injected into the gasifier independently of the feed. In independent injection, the iron compound is either transported pneumatically in nitrogen or carbon dioxide or is carried in a water slurry. Pneumatic injection of both the coal feed and the iron compound is preferred to help minimize the water introduced into the system.

B. Flame Zone

The preferred gasifier is an entrained flow gasifier which includes opposed burners. "Opposed burners" as used herein means one or more pairs of burner outlets into the gasifier, where each pair of burner outlets are arranged substantially opposite one another. Opposed burners are known in the art. An example of opposed burners was given by Newman et al in U.S. Pat. No. 2,516,141, incorporated by reference herein. The paired burner outlets balance each other and should be adjusted so that streams from opposing burner outlets meet, or impinge. The term "flame zone" as used herein refers to the zone formed substantially where the streams from the opposing burners impinge. The temperature in the flame zone is preferably at least about 1650° C., or more preferably at least about 2200° C. The flame zone must be well defined in order to reach the desired flame zone temperature, which is substantially higher than the gasifier temperatures outside of the flame zone. Definition of the flame zone is achieved by adjusted paired burners and by using finely divided, dry feed. The temperature and definition of the flame zone drops, and the invention becomes less useful, as one deviates from opposed burners to single burners, from fine ground coal to coarse ground coal, or from dry feed to slurry feed. Optimum results have been achieved with multiple opposed burners and finely divided, pneumatically conveyed coal and iron-containing compound.

The high temperature of the flame zone makes it difficult to measure directly. However, the flame zone temperature is indicated by calculating the reactor outlet temperature from the outlet gases. Exit temperatures greater than 1300° C. are desirable.

C. Reaction, Conversion, Cooling, and Solids Removal

In the gasifier the coal partially oxides to form synthesis gas, which is primarily carbon monoxide and hydrogen. Under operating conditions without added iron in the flame zone, the coal nitrogen in the coal is known to react to form HCN and/or $NH_3$. The HCN can then further react with moisture in the gasifier to form more $NH_3$. Therefore, if the HCN present in the synthesis gas is reduced, the $NH_3$ should also be reduced.

A substantial amount of the iron compound interacts with the evolving gases, particularly HCN, in the high temperature flame zone. It has been found that at the operating conditions of the invention, the presence of iron results in a reduction in the amount of hydrogen cyanide and/or ammonia present in the synthesis gas product. Without intent that the invention be restricted to any one theory or mechanism of operation, it is believed the at the high temperatures the iron in the iron compound acts as a catalyst to enable destruction of the hydrogen cyanide and/or ammonia to gaseous molecular nitrogen and additional synthesis gas. At the operating conditions of the invention, the iron has not been found to substantially react with the hydrogen cyanide to form iron cyanides or sulfur to form iron sulfides. Two general conditions have been found to contribute to the reduction of hydrogen cyanide and ammonia seen: (1) high temperature in a defined zone; and (2) close proximity of hydrogen cyanide, ammonia, oxygen, and iron. These conditions are uniquely achieved in the flame zone created with the aid of opposed burners and finely divided feed.

The process of this invention is not useful for contemporaneous removal of HCN and sulfur compounds by sulfide formation. The iron present does not appear to substantially react to form metal sulfides. The sulfide level in the flyash does not appear to substantially increase and the sulfur level in the synthesis gas (substantially present as $H_2S$) does not appear to substantially decrease. Preferably, less than about 5% by weight of the iron-containing compound in the gasifier reacts to form metal sulfides. If more than 5% by weight of the iron-containing compound reacts to form metal sulfides, the amount of conversion of HCN to gaseous molecular nitrogen will be reduced absent adding additional iron-containing compound to replace that which forms sulfides.

D. Concentrations of Iron Compound and Percent Removal

The concentration of iron compounds in the feed material varies widely with the type and source of the feed. As a result, varying levels of iron may be needed to correspond to the nitrogen level in the feed and the desired level of hydrogen cyanide and/or ammonia reduction.

In a typical coal gasification process operating absent the practice of the invention, about 90 percent by weight of the coal nitrogen present in the coal forms gaseous molecular nitrogen and the remaining 10 percent by weight forms HCN and/or $NH_3$. With the practice of the invention, the overall conversion of coal nitrogen present in the feed to gaseous molecular nitrogen is increased to the range of about 93 percent to about 99 percent. Preferably the practice of the invention results in a range of about 97 percent by weight to about 99 percent by weight of the total coal nitrogen present in the coal feed forming gaseous molecular nitrogen.

At least an effective amount of iron compound is added to cause a reduction in the hydrogen cyanide and/or ammonia present in the synthesis gas product. The amount of iron added is not more than about 10 percent by weight based on the weight of the coal feed. Preferably, the amount of iron mixed with the feed is not more than about 5 percent by weight iron based on the coal feed. This amount of iron has resulted in good reduction of the hydrogen cyanide and/or ammonia present in the gas stream. Using too much iron is wasteful of the iron compounds and makes the process uneconomical without any apparent additional benefit.

E. Operating Conditions

The gasifier is operated at gasifying conditions. These conditions may vary from feed to feed. The temperature is a temperature high enough to gasify a substantial portion of the coal feed and is well known in the art. Preferred typical temperatures in the gasifier outside of the flame zone are from about 1100° C. to about 2000° C. The gasifier temperature is more preferably from about 1480° C. to about 1760° C. The preferred pressure of the gasifier is greater than about 300 psig and more preferably from about 350 psig to about 370 psig.

As described earlier, the temperature in the flame zone is preferably at least about 1650° C., or more preferably at least about 2200° C. In order to achieve these temperatures, the burners are placed as opposing pairs with impinging streams, and the feed is dry, finely divided particles.

F. Solids Recovery

Iron used in the process passes out of the flame zone and through the gasifier along with the flyash and slag. The iron can be recovered as part of the flyash and slag fines, which become iron-rich. The iron-rich flyash and iron-rich slag fines contain substantially no iron sulfides or iron cyanides formed by reaction with the iron-containing compound. I.e., flyash recovered in the solids separator and slag fines recovered in the water bath indicate the presence of increased amounts of iron present with insubstantial change in sulfide levels and substantially undetectable levels of iron cyanide. Preferably, less than about 5% by weight, based on the total sulfur entering the gasifier, of sulfur is removed as solid iron sulfides. Because the iron in the iron-rich flyash and slag fines does not react to form other compounds, such as sulfides or cyanides, the iron-rich flyash and iron-rich slag fines can be recycled through the gasifier as a highly economical source of iron.

The synthesis gas stream is passed from the gasifier to one or more quenching and/or cooling stages. Flyash is cooled to condense to solid particles. The synthesis gas stream containing the solid particles is passed to one or more solids removal stages. The solids removal stage is preferably a cyclone or ceramic candle filter, used individually or in combination. An electrostatic precipitator is optionally used where the system is at or near atmospheric pressure. The synthesis gas recovered from the solids separation stage has reduced amounts of hydrogen cyanide and/or ammonia but may still need to be scrubbed for the removal of $H_2S$. Preferably the total HCN and ammonia is reduced by at least about 75% volume, about 80% volume, or about 90% volume, more preferably by 95% volume or by 99% volume from that of a similar gasifier not utilizing the process of the invention.

The flyash is recovered from a solids separation unit where it has been captured, preferably in a filter or by an electrostatic precipitation as discussed above. The slag fines drop with the slag into a water bath. The slag sinks to the bottom of the bath and the slag fines float on the surface, where they are recovered. As previously discussed, the flyash and slag fines to be recovered are iron-rich. Since iron is magnetic, one means of recovering the iron-rich flyash and iron-rich slag fines is magnetic attraction. At least a portion of the recovered iron-rich flyash or slag fines are mixed with the coal feed to the gasifier.

Illustrated Embodiment

The following illustrated embodiment is not intended to limit the scope if the invention.

In this embodiment a 250 ton/day dry feed entrained flow gasification reactor was operated with a feed of various coals as identified in the Table below. The temperature outside the flame zone was between 1480° C. and 1760° C. The pressure in the gasifier was between 350 psig and 370 psig. The iron compound was iron-rich flyash recycled from previous gasification runs. The iron compound and the coal feed were mixed in the pulverizer.

TABLE

REDUCTION OF HCN AND $NH_3$ BY ADDITION OF IRON TO FEED

| Coal Feed | Concentration of Iron (% wt) | Concentration of HCN (ppmv) | Concentration of $NH_3$ (ppmv) | Concentration of HCN + $NH_3$ (ppmv) |
|---|---|---|---|---|
| Drayton | 0.82 | 156 | 62 | 218 |
| Drayton | 1.25 | 108 | 63 | 171 |
| Illinois #5 | 1.41 | 61 | 35 | 96 |
| Illinois #5 | 2.05 | 15 | 30 | 45 |
| Pike County | 0.29 | 240 | 260 | 500 |
| Pike County | 0.84 | 180 | 140 | 320 |

Adding varying amounts of an iron compound to the coal feed can be seen to reduce the concentrations of hydrogen cyanide and ammonia in the synthesis gas. Prior to operating at the conditions of the practice of the invention, the synthesis gas product contained a combined total of from about 500 ppmv to about 800 ppmv hydrogen cyanide and/or ammonia based on the synthesis gas. When operating at the conditions of the invention, the synthesis gas contained a combined total of from about 50 ppmv to about 360 ppmv of hydrogen cyanide and ammonia based on the synthesis gas. Preferably, the combined total is not more than about 50 ppmv.

What is claimed is:

1. A method for reducing the hydrogen cyanide content of a gas stream exiting a gasifier comprising:

(a) admixing an iron-containing compound with a dry coal feed containing coal nitrogen, wherein the amount of iron-containing compound admixed with the coal feed results in not more than about 10 percent by weight iron based on the coal feed, and wherein the mixture comprises finely divided particles of iron-containing compound and coal feed;

(b) injecting the mixture into an entrained flow gasifier under gasifying conditions, wherein the gasifier has opposed burners, each said opposed burner comprising a pair of burner outlets arranged substantially opposite one another wherein streams from each said opposed burner outlet impinge to form a flame zone substantially where the streams impinge, said flame zone having a temperature greater than about 1650° C.;

(c) producing a gas stream comprising hydrogen, carbon monoxide, and flyash, and producing slag fines;

(d) recovering the gas stream having at least about 75 volume percent reduced amounts of hydrogen cyanide; and (e) wherein the iron in said admixed iron-containing compound does not substantially react to form metal sulfides in said gasifier.

2. The method according to claim 1 wherein said gasifying conditions outside of said flame zone comprise a temperature in the gasifier from about 1480° C. to about 1760° C.

3. The method according to claim 1 wherein the amount of iron-containing compound admixed with the feed results not more than about 5 percent by weight iron based on the coal feed.

4. The method of claim 3 wherein the iron is recovered as a free iron component in the flyash and the slag fines.

5. The method of claim 4 further comprising:

(a) collecting said flyash in a solids separation unit and collecting said slag fines in a water bath, wherein said flyash and slag fines are iron-rich;

(b) recovering at least a portion of the iron-rich flyash and iron-rich slag fines; and (c) admixing at least a portion of said recovered iron-rich flyash, recovered iron-rich slag fines, or mixtures thereof with the coal feed before gasification.

6. The method according to claim 5 further comprising:

(a) pulverizing said iron-containing compound and said coal feed upstream of the gasifier, wherein the iron-containing compound is admixed with the coal at the pulverizing stage; and (b) pneumatically injecting said mixture into said gasifier.

7. The method according to claim 5 further comprising pulverizing said iron-containing compound and said coal feed upstream of the gasifier, wherein said iron-containing compound is admixed with the coal after the pulverizing stage.

8. The method according to claim 1 wherein the iron-containing compound is selected from the group consisting of iron-rich flyash, iron-rich slag fines, and mixtures thereof.

9. A method for reducing the hydrogen cyanide and ammonia content of a gas stream exiting a gasifier comprising:

(a) admixing an iron-containing compound selected from the group consisting of iron-rich flyash, iron-rich slag fines, and mixtures thereof obtained from step (e) with a nitrogen-containing dry coal feed, wherein the iron-containing compound has at least about 35 percent by weight iron, and wherein the mixture of iron-containing compound and coal feed comprises finely divided particles;

(b) injecting the mixture into an entrained flow gasifier having opposed burners, each said opposed burner comprising a pair of burner outlets arranged substantially opposite one another wherein streams from each said opposed burner outlet impinge to form a flame zone substantially where the streams impinge, said flame zone having a temperature greater than about 1650° C.;

(c) gasifying the coal feed in the resulting mixture under gasifying conditions, thereby producing a gas stream comprising hydrogen, carbon monoxide and flyash, and producing slag fines;

(d) collecting said flyash in a solids separation unit and collecting said slag fines in a water bath, wherein said flyash and slag fines are iron-rich;

(e) magnetically recovering at least a portion of said iron-rich flyash and iron-rich slag fines;

(f) admixing at least a portion of said iron-rich flyash, iron-rich slag fines, or mixtures thereof with the coal feed in step (a); and (g) recovering the gas stream having at least about 80 volume percent reduced amounts of hydrogen cyanide and ammonia;

(h) wherein the iron in said iron-containing compound does not substantially react to form metal sulfides in the gasifier.

10. The method according to claim 9 wherein said gasifying conditions outside of said flame zone comprise a temperature in the gasifier from about 1100° C. to about 2000° C.

11. The method according to claim 10 wherein the temperature in the gasifier outside of said flame zone is from about 1480° C. to about 1760° C.

12. The method according to claim 10 wherein the pressure in the gasifier is greater than about 300 psig.

13. The method according to claim 11 wherein the pressure in the gasifier is from about 350 psig to about 370 psig.

14. The method according to claim 9 wherein more than about 93 percent of the coal nitrogen in the coal is converted to gaseous molecular nitrogen.

15. The method according to claim 14 wherein more than about 97 percent of the coal nitrogen in the coal is converted to gaseous molecular nitrogen.

16. A method for reducing the hydrogen cyanide content of a gas stream exiting a gasifier comprising:

(a) admixing in a coal pulverizing stage a recycled iron-rich flyash with a nitrogen-containing dry coal feed wherein the amount of iron in the mixture is less than about 5 percent by weight iron based on the coal feed, and wherein the mixture of iron-rich flyash and dry coal feed comprises finely divided particles;

(b) injecting the mixture into a dry-feed entrained flow gasifier having a opposed burners, each said opposed burner comprising a pair of burner outlets arranged substantially opposite one another wherein streams from each said opposed burner outlet impinge to form a flame zone substantially where the streams impinge, said flame zone having a temperature greater than about 1650° C.;

(c) gasifying the coal feed in the resulting mixture under gasifying conditions, wherein said gasifier is at a pressure greater than about 300 psig and a temperature outside of said flame zone from about 1100° C. up to about 2200° C., thereby producing a gas stream comprising hydrogen, carbon monoxide and flyash, wherein at least about 95 percent of the nitrogen in the coal is converted to gaseous molecular nitrogen, and wherein substantially no sulfides are formed in said flame zone by reaction with the iron in said iron-containing compound;

(d) collecting said flyash in a solids separation unit, wherein said flyash is iron-rich;

(e) magnetically recovering at least a portion of said iron-rich flyash and mixing at least a portion of said iron-rich flyash with the coal feed in step (a); and (f) recovering the gas stream having at least about 95 volume percent reduced amounts of hydrogen cyanide;

(g) wherein said iron-containing compound does not substantially react to form metal sulfides in the gasifier.

17. The method according to claim 16 wherein the iron-rich flyash is dry at the point of admixture with said coal.

18. The method of claim 17 wherein the mixture of coal and iron-rich flyash is pneumatically injected into the gasifier.

19. In a method for gasification of coal in an entrained flow gasifier having opposed burners, each said opposed burner comprising a pair of burner outlets arranged substantially opposite one another wherein streams from each said opposed burner outlet impinge to form an impinging flame zone, the improvement which yields lower hydrogen cyanide levels in a gas stream exiting said gasifier, said improvement comprising:

(a) admixing an iron-containing compound with a coal nitrogen-containing dry coal feed to produce an iron compound-coal mixture having not more than about 5 percent by weight iron based on the coal feed, wherein the mixture comprises finely divided particles, and wherein said mixture is dry;

(b) injecting said dry mixture into said entrained flow gasifier, wherein the temperature generated in said impinging flame zone is significantly high that iron present will not combine with sulfur present to form iron sulfides;

(c) gasifying the coal in said iron compound-coal mixture in the impinging flame zone, thereby producing a gas stream comprising hydrogen, carbon monoxide and flyash, and producing slag fines;

(d) recovering said flyash and said slag fines, wherein said flyash and slag fines are iron-rich and comprise substantially no iron sulfides formed by reaction with iron in said iron-containing compound;

(f) mixing at least a portion of said iron-rich flyash or iron-rich slag fines with the coal feed in step (a); and (g) recovering the gas stream having reduced amounts of hydrogen cyanide.

* * * * *